US006942309B2

(12) United States Patent
Huang et al.

(10) Patent No.: US 6,942,309 B2
(45) Date of Patent: Sep. 13, 2005

(54) PRINTING APPARATUS AND METHOD FOR MAINTAINING TEMPERATURE OF A PRINTHEAD

(75) Inventors: Chien-Chih Huang, Tai-Chung Hsien (TW); Chun-Jen Lee, Taipei Hsien (TW)

(73) Assignee: BenQ Corporation, Tao-Yuan Hsien (TW)

( * ) Notice: Subject to any disclaimer, the term of this patent is extended or adjusted under 35 U.S.C. 154(b) by 60 days.

(21) Appl. No.: 10/605,503

(22) Filed: Oct. 3, 2003

(65) Prior Publication Data

US 2005/0073555 A1 Apr. 7, 2005

(51) Int. Cl.[7] ..... B41J 29/38
(52) U.S. Cl. ..... 347/14; 347/17
(58) Field of Search ..... 347/14, 17, 19, 347/56–59, 61

(56) References Cited

U.S. PATENT DOCUMENTS 5,107,276 A * 4/1992 Kneezel et al. ..... 347/14

* cited by examiner

*Primary Examiner*—Juanita D. Stephens
(74) *Attorney, Agent, or Firm*—Winston Hsu

(57) ABSTRACT

A printing apparatus includes a printhead for ejecting ink from a plurality of sets of nozzles. The printhead includes a substrate and a plurality of heaters arranged on the substrate for heating ink in the printhead to generate bubbles in the ink and eject the ink through corresponding nozzles. The printing apparatus also includes a data transducer for translating raw data into printing data, a counter for counting a total quantity of printing data value sent to each set of nozzles, a memory for storing the total quantity of printing data value corresponding to each set of nozzles, and a head driver circuit. The head driver circuit generates printing signals and non-printing signals corresponding to each set of nozzles according to the printing data provided by the data transducer and the total quantity of printing data value stored in the memory.

22 Claims, 9 Drawing Sheets

PRINTING APPARATUS AND METHOD FOR MAINTAINING TEMPERATURE OF A PRINTHEAD

BACKGROUND OF INVENTION

1. Field of the Invention

The present invention relates to a printhead of a printing apparatus, and more specifically, to a method for maintaining a temperature of the printhead according to an amount of data printed.

2. Description of the Prior Art

An inkjet printer forms a printed image by printing a pattern of individual dots at particular locations of an array defined for the printing medium. The locations are conveniently visualized as being small dots in a rectilinear array, and will be referred to as dot locations. Thus, the printing operation can be viewed as the filling of a pattern of dot locations with dots of ink.

Inkjet printers print dots by ejecting very small drops of ink onto the print medium, and typically include a movable carriage that supports one or more printheads, each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of dot locations of the image being printed.

Color inkjet printers commonly employ a plurality of printheads, for example four, mounted in the print carriage to produce different colors. Each printhead contains ink of a different color, with the commonly used colors being cyan, magenta, yellow, and black. These base colors are produced by depositing a drop of the required color onto a dot location, while secondary or shaded colors are formed by depositing multiple drops of different base color inks onto the same dot location, with the overprinting of two or more base colors producing secondary colors according to well established optical principles.

The typical inkjet printhead (i.e., the silicon substrate, structures built on the substrate, and connections to the substrate) uses liquid ink (i.e., colorants dissolved or dispersed in a solvent). It has an array of precisely formed nozzles attached to a printhead substrate that incorporates an army of firing chambers which receive liquid ink from the ink reservoir. Each chamber has a thin-film resistor, known as an inkjet firing chamber resistor, located opposite the nozzle so ink can collect between it and the nozzle. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

Print quality is one of the most important considerations of competition in the color inkjet printer field. Since the image output of a color inkjet printer is formed of thousands of individual ink drops, the quality of the image is ultimately dependent upon the quality of each ink drop and the arrangement of the ink drops on the print medium. One source of print quality degradation is improper ink drop volume.

Drop volume variations result in degraded print quality and have prevented the realization of the full potential of inkjet printers. Drop volumes vary with the printhead substrate temperature because the two properties that control it vary with printhead substrate temperature: the viscosity of the ink and the amount of ink vaporized by a firing chamber resistor when driven with a printing pulse. Drop volume variations commonly occur during printer startup, during changes in ambient temperature, and when the printer output varies, such as a change from normal print to "black-out" print (i.e. where the printer covers the page with dots.)

Variations in drop volume degrades print quality by causing variations in the darkness of black-and-white text, variations in the contrast of gray-scale images, and variations in the chroma, hue, and lightness of color images. The chroma, hue, and lightness of a printed color depends on the volume of all the primary color drops that create the printed color. If the printhead substrate temperature increases or decreases as the page is printed, the colors at the top of the page can differ from the colors at the bottom of the page. Reducing the range of drop volume variations will improve the quality of printed text, graphics, and images.

Additional degradation in the print quality is caused by excessive amounts of ink in the larger drops. When at room temperature, an inkjet printhead must eject drops of sufficient size to form satisfactory printed dots. However, previously known printheads that meet this performance requirement eject drops containing excessive amounts of ink when the printhead substrate is warm. The excessive ink degrades the print by causing feathering of the ink drops, bleeding of ink drops having different colors, and cockling and curling of the paper. Reducing the range of drop volume variation would help eliminate this problem.

Inkjet cartridge performance can vary widely due to the temperature of the ink firing chamber and therefore the ejected ink. Due to changes of the physical constants of the ink, the nucleation dynamics, and the refill characteristics of an inkjet printhead due to substrate temperature, the control of the temperature is necessary to guarantee consistently good image print quality. The cartridge substrate temperature can vary due to ambient temperature, servicing, and the amount of printing done with the cartridge.

SUMMARY OF INVENTION

It is therefore a primary objective of the claimed invention to provide a printing apparatus and method of maintaining a temperature of a printhead according to an amount of data printed in order to solve the above-mentioned problems.

According to the claimed invention, a printing apparatus includes a printhead for ejecting ink from a plurality of sets of nozzles. The printhead includes a substrate and a plurality of heaters arranged on the substrate for heating ink in the printhead to generate bubbles in the ink and eject the ink through corresponding nozzles. The printing apparatus also includes a data transducer for translating raw data into printing data, a counter for counting a total quantity of printing data value sent to each set of nozzles, a memory for storing the total quantity of printing data value corresponding to each set of nozzles, and a head driver circuit. The head driver circuit generates printing signals and non-printing signals corresponding to each set of nozzles according to the printing data provided by the data transducer and the total quantity of printing data value stored in the memory, the printing signals controlling the heaters to generate sufficient heat energy to eject ink from the nozzles for printing data, and the non-printing signals controlling the heaters to generate heat energy that is not sufficient to eject ink from the nozzles for raising a temperature of the ink.

It is an advantage of the claimed invention that the present invention generates the printing and non-printing pulses according to the total quantity of printing data value stored in the memory for properly maintaining the temperature of the printhead according to an amount of data printed by each set of nozzles.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 1:
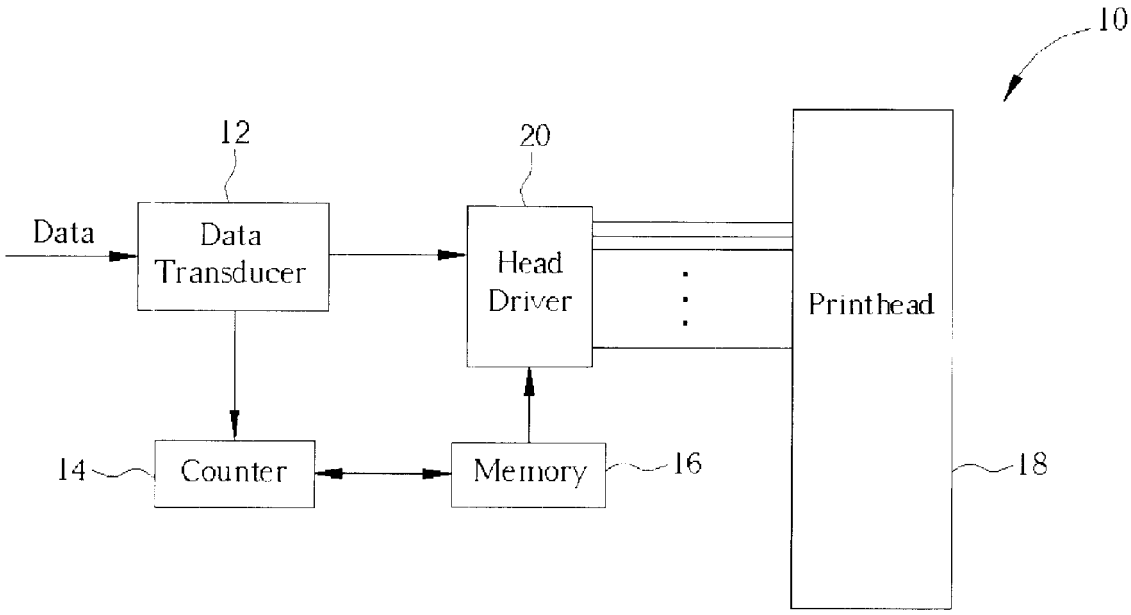
FIG. 1 is a block diagram of a printing apparatus according to the present invention.

Please refer to FIG. 1. FIG. 1 is a block diagram of a printing apparatus 10 according to the present invention. The printing apparatus 10 comprises a data transducer 12 for translating raw data into print data and outputting the print data to a head driver circuit 20. The print data contains a value of either "0" or "1". The print data with the "0" value represents that no data is to be printed whereas the print data with the "1" value represents that ink will be printed on a dot location. The head driver circuit 20 is responsible for receiving the print data from the data transducer 12, generating non-printing pulses corresponding to the "0" values, and generating printing pulses corresponding to the "1" values. The printing and non-printing pulses produced by the head driver circuit 20 are then sent to a printhead 18.

Figure 2:
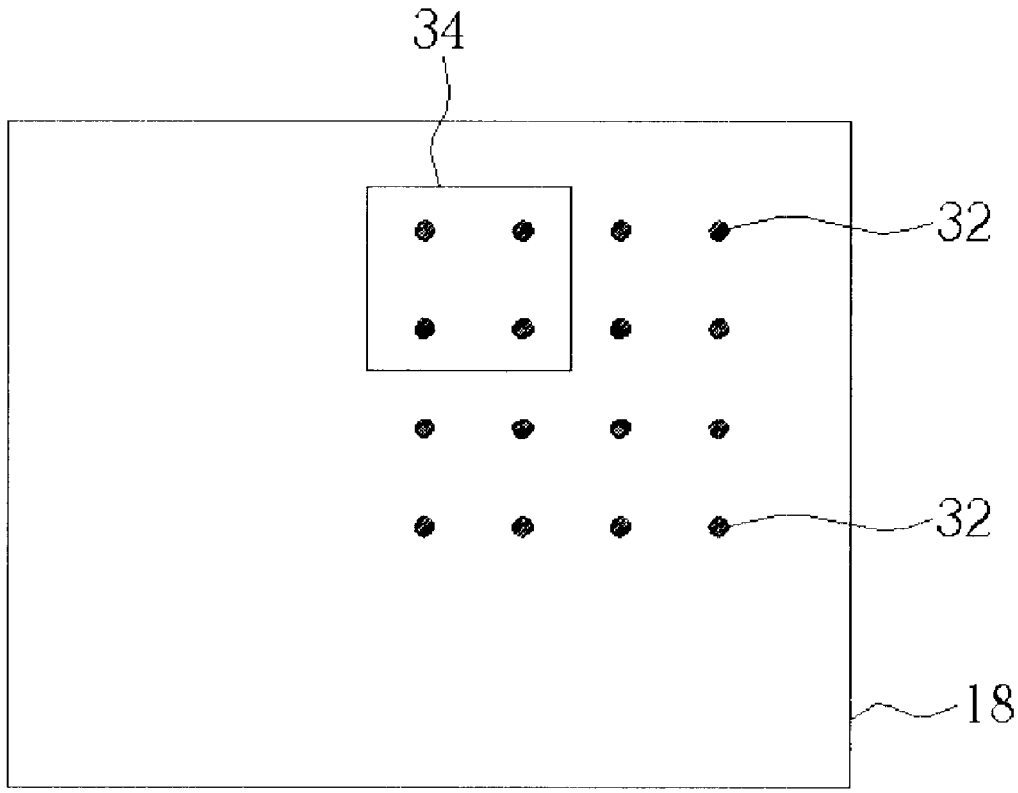
FIG. 2 shows a plurality of nozzles formed on the printhead.
Figure 9:
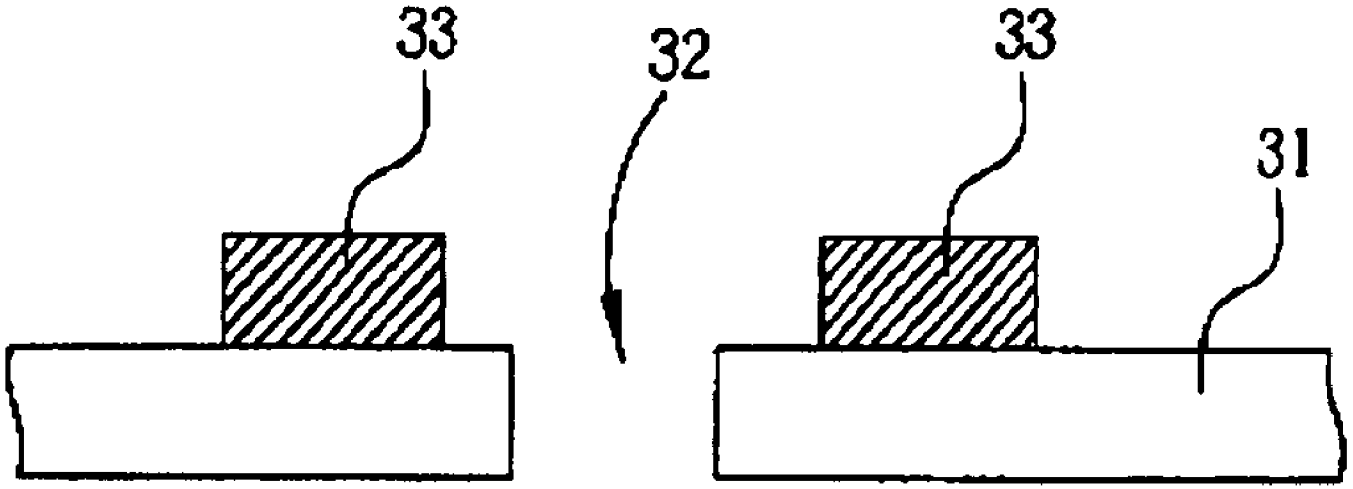
FIG. 9 shows heaters formed on a substrate for ejecting ink from a nozzle.

Please refer to FIG. 9 and FIG. 2 with reference to FIG. 1 FIG. 9 shows heaters 33 formed on a substrate 31 for ejecting ink from a nozzle 32. FIG. 2 shows a plurality of the nozzles 32 formed on the printhead 18. The plurality of nozzles 32 eject ink droplets according to the printing and non-printing pulses received from the head driver circuit 20. As shown in FIG. 9, the printhead 18 further comprises the plurality of heaters 33 for heating up ink, and for creating bubbles in the ink to cause ink to eject from the corresponding nozzles 32. As more and more ink is ejected from each nozzle 32 or group 34 of nozzles 32, the temperature of the ink will increase. To compensate for this, the present invention utilizes a counter 14 for measuring the quantity of data printed. As the data transducer 12 sends the print data to the head driver circuit 20, the data transducer 12 also sends the print data to the counter 14. The counter 14 can count print data information for either individual nozzles 32 or for each group 34 of nozzles 32, depending on the wishes of the manufacturer. If the counter 14 is used for a group 34 of nozzles 32, nozzles 32 in the group 34 of nozzles 32 are preferably in close proximity to each other. For the following disclosure, assume that the counter 14 counts print data information for each group 34 of nozzles 32, and stores a total quantity of printing data value corresponding to each group 34 of nozzles 32 in a memory 16. When the data transducer 12 outputs print data having a value of "1" to a nozzle 32 within a specific group 34 of nozzles 32, the counter 14 reads the previous total quantity of printing data value stored in the memory 16, increases the value, and stores the increased value into the memory 16. On the other hand, when the data transducer 12 outputs print data having a value of "0" to a nozzle 32 within a specific group 34 of nozzles 32, the counter 14 reads the previous total quantity of printing data value stored in the memory 16, decreases the value, and stores the decreased value into the memory 16.

When the head driver circuit 20 receives the print data from the data transducer 12 destined for a specific nozzle 32, the head driver circuit 20 searches the memory 16 for the previous value of the total quantity of printing data value for the corresponding group 34 of nozzles 32. Based on the total quantity of printing data value, the head driver circuit 20 will then decide the characteristics of the printing or non-printing pulses to send to the nozzle 32, as will be explained in detail below. While the head driver circuit 20 drives the nozzle 32 in the printhead 18, the corresponding total quantity of printing data value is updated in the memory 16.

Figure 3:
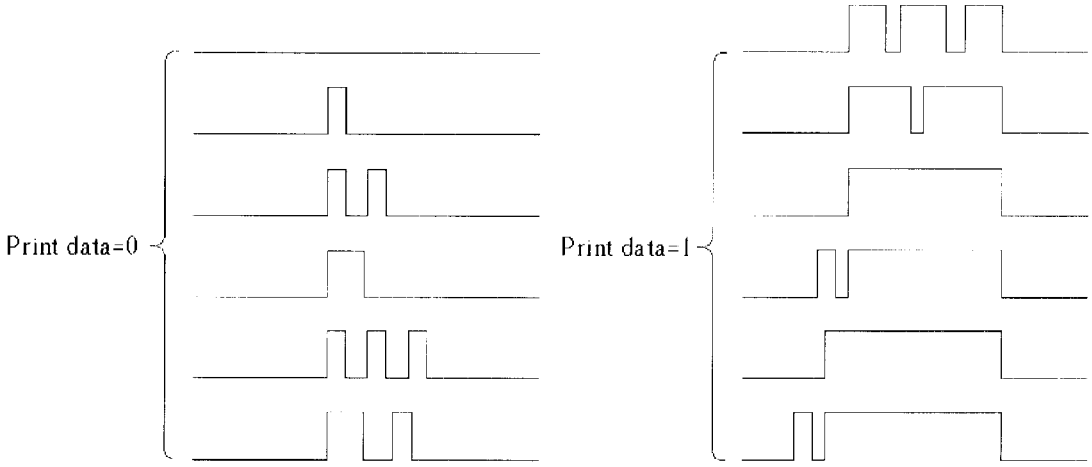
FIG. 3 shows variations of non-printing pulses and printing pulses according to the present invention.

Please refer to FIG. 3. FIG. 3 shows variations of non-printing pulses and printing pulses according to the present invention. Six variations of each are shown. The six signals on the left are non-printing pulses corresponding to print data with a value of "0". Conversely, the six signals on the right are printing pulses corresponding to print data with a value of "1". In each case, signals are arranged in order of increasing energy. For example, the first signal for the non-printing pulses would impart no energy to a heater 33 corresponding to the specified nozzle 32. On the other hand, the last signal for the non-printing pulses would impart a significant amount of energy to the heater 33 corresponding to the specified nozzle 32. The printing and non-printing pulses are selected by the head driver circuit 20 according to the total quantity of printing data value corresponding to the specified nozzle 32, which the head driver circuit 20 reads from the memory 16. The lower the total quantity of printing data value stored in the memory 16 is, the less energy the selected printing and non-printing pulses will have, and vice-versa.

Figure 4:
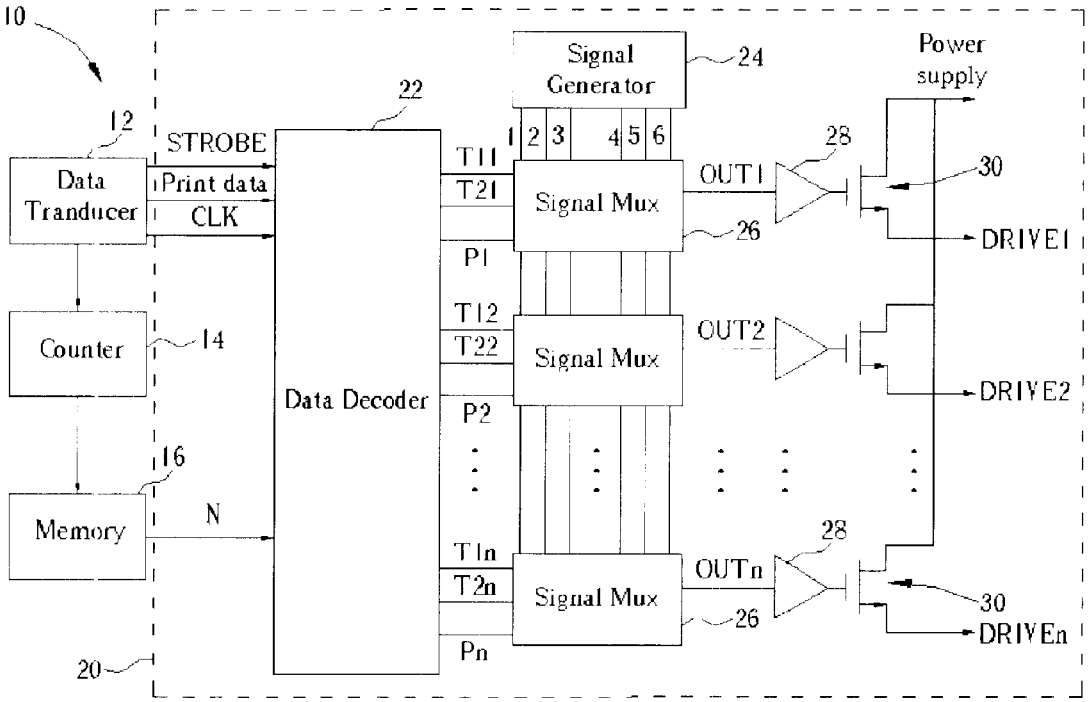
FIG. 4 shows a detailed block diagram of a head driver circuit according to the present invention.

Please refer to FIG. 4. FIG. 4 shows a detailed block diagram of the head driver circuit 20 according to the present invention. The head driver circuit 20 contains a data decoder 22 for receiving the print data for a selected nozzle 32 from the data transducer 12, comparing the corresponding total quantity of printing data value stored in the memory 16 to a plurality of reference values, and outputting the data along with the comparison results to a plurality of signal multiplexers 26. The data decoder 22 receives a strobe signal STROBE from the data transducer 12 for activating the data decoder 22, the print data signal for receiving the print data to be printed by the selected nozzle 32, and a clock signal CLK for synchronizing the operations of the data decoder 22. In addition, the data decoder 22 reads from the memory 16 the total quantity of printing data value N corresponding to the selected nozzle 32. The data decoder 22 will then compare the total quantity of printing data value N with at least one reference value to determine which printing and non-printing pulses should be generated by a signal generator 24.

Figure 5:
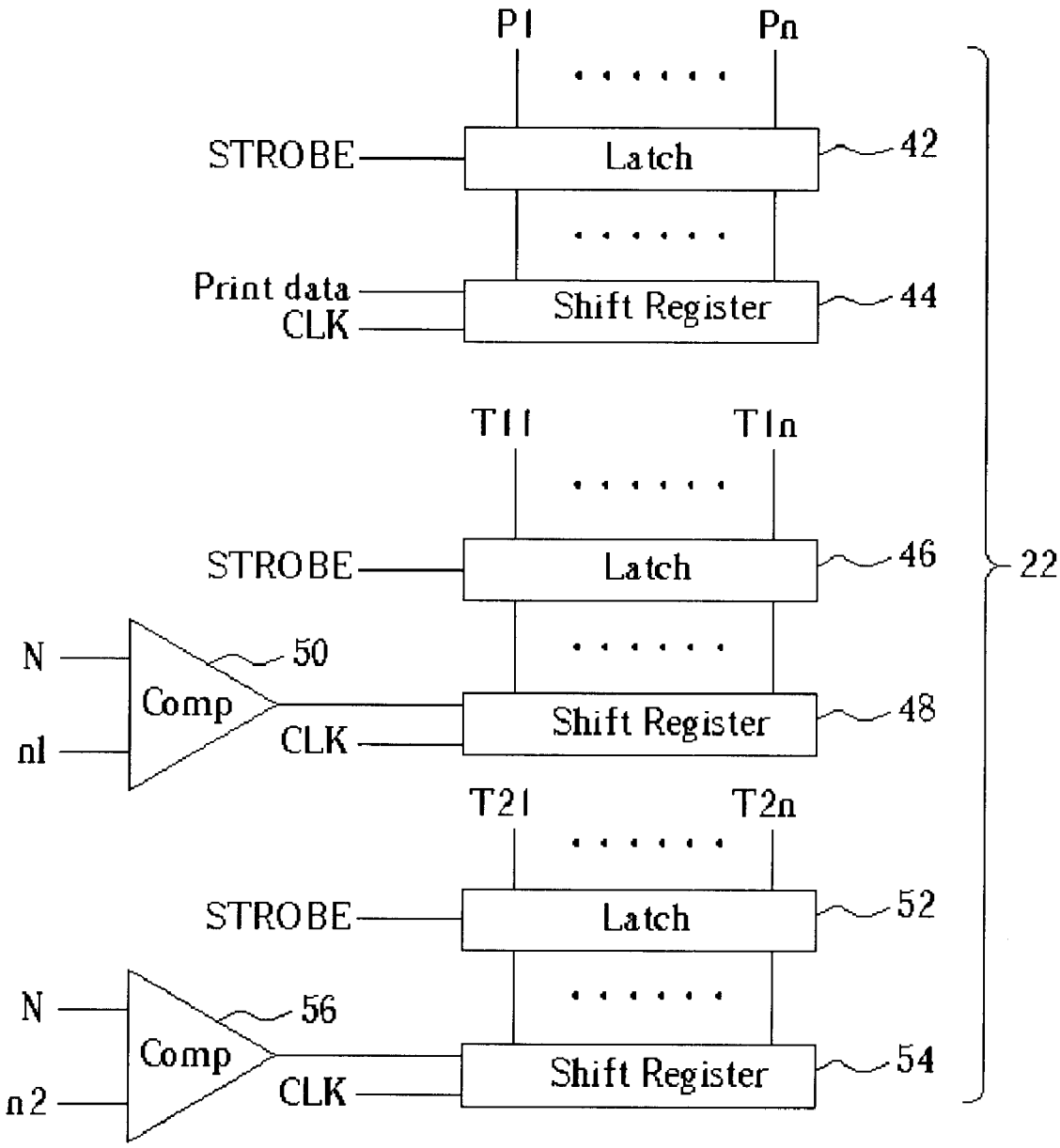
FIG. 5 shows a detailed block diagram of a data decoder shown in FIG. 4.

Please refer to FIG. 5 with reference to FIG. 4. FIG. 5 shows a detailed block diagram of the data decoder 22 shown in FIG. 4. The data decoder 22 contains first, second, and third latches 42, 46, and 52, and corresponding first, second, and third shift registers 44, 48, and 54. The data decoder 22 shown in FIG. 5 can control all nozzles 32 within the group 34 of nozzles 32 at any one time, and the nozzles 32 are given identification numbers ranging from 1 to n. In this example, each nozzle 32 within the group 34 of nozzles 32 is controlled by a unique input power pad, and the power pads have respective print data values labeled P1 to Pn. Print data values P1 to Pn are shifted into the first shift register 44 one-by-one with the aid of the first latch 42. At the same time, corresponding total quantity of printing data values N are compared with two reference values n1 and n2. As an example, only two reference values n1 and n2 are shown, although more can be used if desired. First and second comparators 50 and 56 are respectively used to compare the total quantity of printing data value N to each of the reference values n1 and n2. After comparing the total quantity of printing data values N to reference value n1, the first comparator 50 outputs a plurality of comparison results T11 to T1n to the second shift register 48. The second latch 46 is used to shift the comparison results T11 to T1n into the second shift register 48 one-by-one. Meanwhile, the second comparator 56 compares the total quantity of printing data values N to reference value n2 and outputs a plurality of comparison results T21 to T2n to the third shift register 54. The third latch 52 is used to shift the comparison results T21 to T2n into the third shift register 54 one-by-one. Finally, the contents of the first, second, and third shift registers 44, 48, 54 are all outputted to the corresponding signal multiplexer 26.

Figure 6:
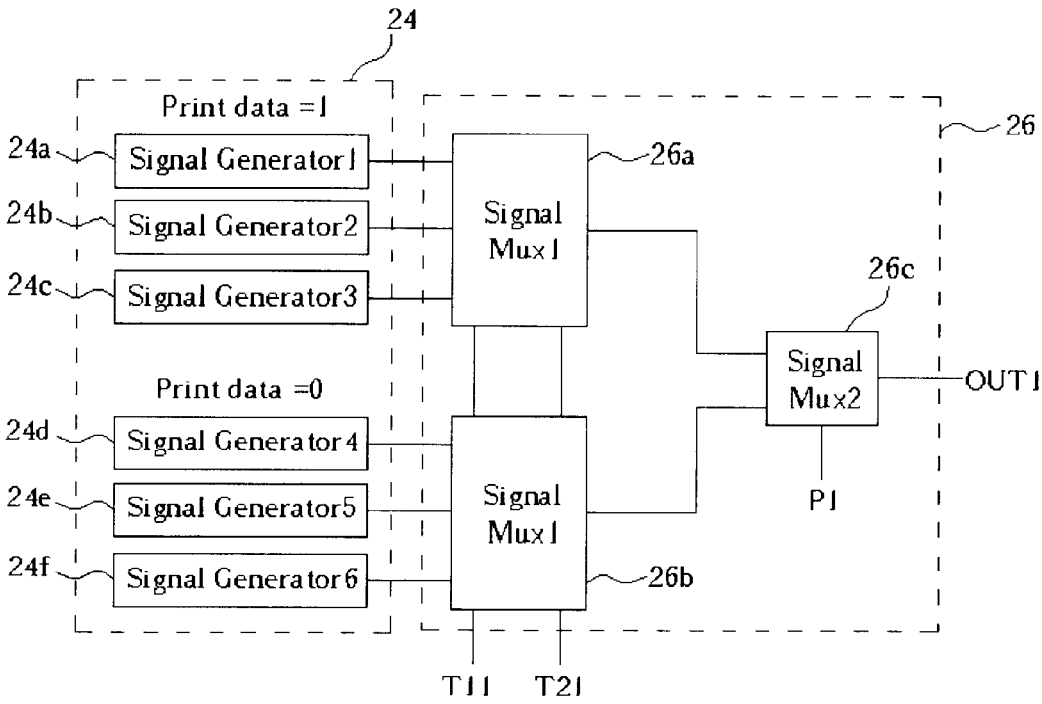
FIG. 6 shows a detailed block diagram of a signal multiplexer communicating with the signal generator.

Please refer to FIG. 6 with reference to FIG. 4. FIG. 6 shows a detailed block diagram of one of the signal multiplexers 26 communicating with the signal generator 24. In the example shown in FIG. 6, the signal generator 24 is composed of a plurality of sub-signal generators 24*a*–24*f*, and each signal multiplexer 26 is composed of sub-multiplexers 26*a*–26*c*. Since only the first and second comparators 50 and 56 were used to compare the level of the total quantity of printing data value N, only three sub-signal generators 24*a*–24*c* are needed for generating the three possible printing signals. Likewise, only three sub-signal generators 24*d*–24*f* are needed for generating the three possible non-printing signals. The three printing signals outputted from sub-signal generators 24*a*–24*c* are sent to sub-multiplexer 26*a*, and the three non-printing signals outputted from sub-signal generators 24*d*–24*f* are sent to sub-multiplexer 26*b*. The output signals of sub-multiplexer 26*a* and sub-multiplexer 26*b* are controlled by the comparison results T11 and T21 from the first and second comparators 50 and 56. Next, sub-multiplexer 26*c* is used to select printing or non-printing signals based on the value of the print data P1 for the corresponding nozzle 32. In this way, the three sub-multiplexers 26*a*–26*c* are used to select one output signal OUT1 from the six sub-signal generators 24*a*–24*f*.

Please refer back to FIG. 4. The head driver circuit 20 drives each nozzle 32 of the printhead 18 independently. The following description will use the nozzle 32 print data value P1 as an example of controlling each individual nozzle 32. The data decoder 22 outputs comparison results T11 and T21 and the print data value P1 to the signal multiplexer 26 corresponding to the selected nozzle 32 for choosing the output signal OUT1 from the signal generator 24. The output signal OUT1 is then sent through a buffer 28 before being sent to a switching device 30, such as a MOS transistor. The switching device 30 then sends a driving signal DRIVE1 to the printhead 18 for controlling the selected nozzle 32.

Figure 7:
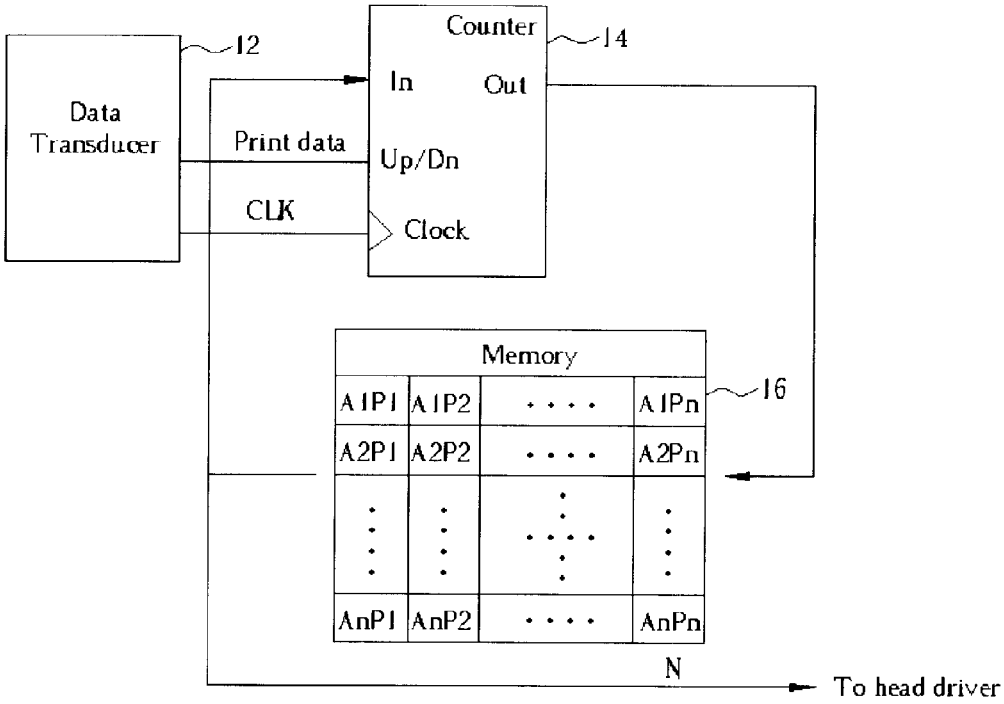
FIG. 7 provides a detailed look at interaction between a data transducer, counter, and memory according to the present invention.

Please refer to FIG. 7. FIG. 7 provides a detailed look at interaction between the data transducer 12, counter 14, and memory 16. The data transducer 12 sends print data information for each nozzle 32 or group 34 of nozzles 32 to the counter 14. After receiving the print data information from the data transducer 12, the counter 14 first reads the previous total quantity of printing data value N stored in the memory 16. Next, based on the value of the print data, the counter 14 then increases or decreases the corresponding total quantity of printing data value N, and stores the updated value back into the memory 16. As mentioned earlier, when the value of the print data is "0", the counter 14 decreases the total quantity of printing data value N before storing the decreased value back into memory 16. However, if the previous total quantity of printing data value N is already below a predetermined lower bound, the total quantity of printing data value N is not further decreased. Similarly, when the value of the print data is "1", the counter 14 increases the total quantity of printing data value N before storing the increased value back into memory 16. If the previous total quantity of printing data value N is already above a predetermined upper bound, the total quantity of printing data value N is not further increased. The counter 14 is also capable of determining when a specific nozzle 32 was last used to print data. If the nozzle 32 has not been used for over a predetermined period of time, the total quantity of printing data value N corresponding to the nozzle 32 will be reset back to a default value since the temperature of the ink used in the nozzle 32 has cooled off.

Figure 8:
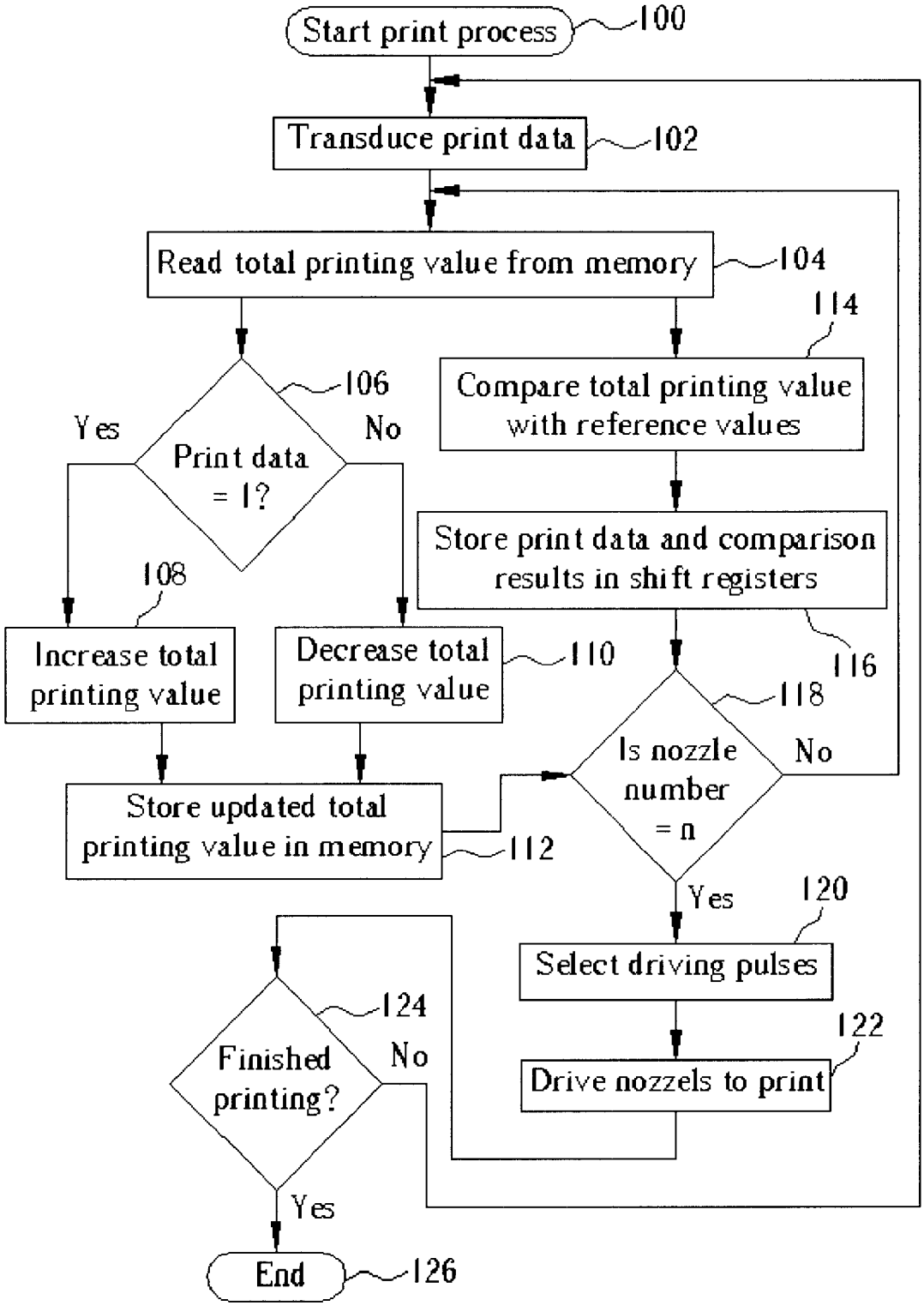
FIG. 8 is a flowchart illustrating printing data with a group of nozzles according to the present invention method.

Please refer to FIG. 8. FIG. 8 is a flowchart illustrating printing data with a group 34 of nozzles 32 according to the present invention method. Steps contained in the flowchart will be explained below.

Step 100: Start the process of printing data from each nozzle 32 in a selected group 34 of nozzles 32;

Step 102: Transduce print data with the data transducer 12;

Step 104: For a current nozzle 32 in the group 34 of nozzles 32, read the corresponding total quantity of printing data value from the memory 16. Then simultaneously perform steps 106 and steps 114;

Step 106: Determine if the value of the print data is equal to "1"; if so, go to step 108; if not, go to step 110;

Step 108: Since the value of the print data is equal to "1", increase the total quantity of printing data value; go to step 112;

Step 110: Since the value of the print data is equal to "0", decrease the total quantity of printing data value;

Step 112: Store the updated total quantity of printing data value in the memory 16; go to step 118;

Step 114: Compare the total quantity of printing data value corresponding to the current nozzle 32 with a plurality of reference values;

Step 116: Store the print data and the comparison results in shift registers 44, 48, and 54;

Step 118: Determine if the current nozzle 32 has a nozzle 32 identification number equal to n. In other words, determine if this is the last nozzle 32 in the selected group 34 of nozzles 32; if so, go to step 120; if not, go back to step 104 to repeat the above process for a next nozzle 32 in the selected group 34 of nozzles 32;

Step 120: Utilize the signal generator 24 and the multiplexers 26 to select driving pulses for each nozzle 32 in the group 34 of nozzles 32;

Step 122: Drive the nozzles 32 in the group 34 of nozzles 32 with the selected driving pulses;

Step 124: Determine if the printing process is finished; if so, go to step 126; if not, go back to step 102 for driving a next group 34 of nozzles 32 to print;

Step 126: End.

In summary, the present invention printing apparatus 10 does not need a temperature sensor to maintain the temperature of ink in the printhead 18. Instead, the counter 14 is used to calculate the total quantity of printing data value for either individual nozzles 32 or for groups 34 of nozzles 32 based on the amount of data printed. Printing and non-printing pulses of varying energy levels are then selected based on the total quantity of printing data value, ensuring that the temperature of the ink is maintained at a proper temperature.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A printing apparatus comprising:

a printhead for ejecting ink from a plurality of sets of nozzles, the printhead comprising:

a substrate; and a plurality of heaters arranged on the substrate for heating ink in the printhead to generate bubbles in the ink and eject the ink through corresponding nozzles;

a data transducer for translating raw data into printing data;

a counter for counting a total quantity of printing data value sent to each set of nozzles;

a memory for storing the total quantity of printing data value corresponding to each set of nozzles; and a head driver circuit for generating printing signals and non-printing signals corresponding to each set of nozzles according to the printing data provided by the data transducer and the total quantity of printing data value stored in the memory, the printing signals controlling the heaters to generate sufficient heat energy to eject ink from the nozzles for printing data, and the non-printing signals controlling the heaters to generate heat energy that is not sufficient to eject ink from the nozzles for raising a temperature of the ink, the head driver circuit comprising:

a signal generator for generating a plurality of printing signals and non-printing signals having unique energy values;

a comparator for comparing the total quantity of printing data value stored in the memory with a plurality of reference values; and a selector circuit for selecting printing and non-printing signals generated by the signal generator to be sent to the corresponding set of nozzles based on the comparison results given by the comparator.

2. The printing apparatus of claim 1 wherein each set of nozzles consists of a single nozzle.

3. The printing apparatus of claim 1 wherein each set of nozzles consists of a plurality of nozzles.

4. The printing apparatus of claim 3 wherein the plurality of nozzles in each set of nozzles are located adjacent to each other.

5. The printing apparatus of claim 1 wherein the counter increases the total quantity of printing data value corresponding to each set of nozzles for each printing signal sent to the set of nozzles.

6. The printing apparatus of claim 1 wherein the total quantity of printing data value corresponding to each set of nozzles is kept constant for each printing signal sent to the set of nozzles if the total quantity of printing data value is greater than a predetermined threshold value.

7. The printing apparatus of claim 1 wherein the counter decreases the total quantity of printing data value corresponding to each set of nozzles for each non-printing signal sent to the set of nozzles.

8. The printing apparatus of claim 1 wherein the total quantity of printing data value corresponding to each set of nozzles is reset if no printing signal is sent to the set of nozzles during a predetermined period of time.

9. A method for heating a printhead in a printing apparatus, the printing apparatus comprising:

a printhead for ejecting ink from a plurality of sets of nozzles, the printhead comprising:

a substrate; and a plurality of heaters arranged on the substrate for heating ink in the printhead to generate bubbles in the ink and eject the ink through corresponding nozzles; and a data transducer for translating raw data into printing data;

the method comprising:

counting a total quantity of printing data value sent to each set of nozzles;

storing the total quantity of printing data value corresponding to each set of nozzles in a memory;

generating a plurality of printing signals and non-printing signals having unique energy values;

comparing the total quantity of printing data value stored in the memory with a plurality of reference values; and selecting printing and non-printing signals to be sent to the corresponding set of nozzles based on the comparison results.

10. The method of claim 9 wherein each set of nozzles consists of a single nozzle.

11. The method of claim 9 wherein each set of nozzles consists of a plurality of nozzles.

12. The method of claim 11 wherein the plurality of nozzles in each set of nozzles are adjacent to each other.

13. The method of claim 9 further comprising increasing the total quantity of printing data value corresponding to each set of nozzles for each printing signal sent to the set of nozzles.

14. The method of claim 9 further comprising keeping the total quantity of printing data value corresponding to each set of nozzles constant for each printing signal sent to the set of nozzles if the total quantity of printing data value is greater than a predetermined threshold value.

15. The method of claim 9 further comprising decreasing the total quantity of printing data value corresponding to each set of nozzles for each non-printing signal sent to the set of nozzles.

16. The method of claim 9 further comprising resetting the total quantity of printing data value corresponding to each set of nozzles if no printing signal is sent to the set of nozzles during a predetermined period of time.

17. A printing apparatus comprising:

a printhead for ejecting ink from a plurality of sets of nozzles, each set of nozzles consisting of a plurality of nozzles, the printhead comprising:

a substrate; and a plurality of heaters arranged on the substrate for heating ink in the printhead to generate bubbles in the ink and eject the ink through corresponding nozzles;

a data transducer for translating raw data into printing data;

a counter for counting a total quantity of printing data value sent to each set of nozzles;

a memory for storing the total quantity of printing data value corresponding to each set of nozzles; and a head driver circuit for generating printing signals and non-printing signals corresponding to each set of nozzles according to the printing data provided by the data transducer and the total quantity of printing data value stored in the memory, the printing signals controlling the heaters to generate sufficient heat energy to eject ink from the nozzles for printing data, and the non-printing signals controlling the heaters to generate heat energy that is not sufficient to eject ink from the nozzles for raising a temperature of the ink.

18. A printing apparatus comprising:

a printhead for ejecting ink from a plurality of sets of nozzles, the printhead comprising:

a substrate; and a plurality of heaters arranged on the substrate for heating ink in the printhead to generate bubbles in the ink and eject the ink through corresponding nozzles;

a data transducer for translating raw data into printing data;

a counter for counting a total quantity of printing data value sent to each set of nozzles, wherein the total quantity of printing data value corresponding to each set of nozzles is kept constant for each printing signal sent to the set of nozzles if the total quantity of printing data value is greater than a predetermined threshold value;

a memory for storing the total quantity of printing data value corresponding to each set of nozzles; and a head driver circuit for generating printing signals and non-printing signals corresponding to each set of nozzles according to the printing data provided by the data transducer and the total quantity of printing data value stored in the memory, the printing signals controlling the heaters to generate sufficient heat energy to eject ink from the nozzles for printing data, and the non-printing signals controlling the heaters to generate heat energy that is not sufficient to eject ink from the nozzles for raising a temperature of the ink.

19. A printing apparatus comprising:

a printhead for ejecting ink from a plurality of sets of nozzles, the printhead comprising:

a substrate; and a plurality of heaters arranged on the substrate for heating ink in the printhead to generate bubbles in the ink and eject the ink through corresponding nozzles;

a data transducer for translating raw data into printing data;

a counter for counting a total quantity of printing data value sent to each set of nozzles, wherein the counter decreases the total quantity of printing data value corresponding to each set of nozzles for each non-printing signal sent to the set of nozzles;

a memory for storing the total quantity of printing data value corresponding to each set of nozzles; and a head driver circuit for generating printing signals and non-printing signals corresponding to each set of nozzles according to the printing data provided by the data transducer and the total quantity of printing data value stored in the memory, the printing signals controlling the heaters to generate sufficient heat energy to eject ink from the nozzles for printing data, and the non-printing signals controlling the heaters to generate heat energy that is not sufficient to eject ink from the nozzles for raising a temperature of the ink.

20. A method for heating a printhead in a printing apparatus, the printing apparatus comprising:

a printhead for ejecting ink from a plurality of sets of nozzles, each set of nozzles consisting of a plurality of nozzles, the printhead comprising:

a substrate; and a plurality of heaters arranged on the substrate for heating ink in the printhead to generate bubbles in the ink and eject the ink through corresponding nozzles; and a data transducer for translating raw data into printing data;

the method comprising:

counting a total quantity of printing data value sent to each set of nozzles;

storing the total quantity of printing data value corresponding to each set of nozzles in a memory; and generating printing signals and non-printing signals corresponding to each set of nozzles according to the printing data provided by the data transducer and the total quantity of printing data value stored in the memory, the printing signals controlling the heaters to generate sufficient heat energy to eject ink from the nozzles for printing data, and the non-printing signals controlling the heaters to generate heat energy that is not sufficient to eject ink from the nozzles for raising a temperature of the ink.

21. A method for heating a printhead in a printing apparatus, the printing apparatus comprising:

a printhead for ejecting ink from a plurality of sets of nozzles, the printhead comprising:

a substrate; and a plurality of heaters arranged on the substrate for heating ink in the printhead to generate bubbles in the ink and eject the ink through corresponding nozzles; and a data transducer for translating raw data into printing data;

the method comprising:

counting a total quantity of printing data value sent to each set of nozzles;

keeping the total quantity of printing data value corresponding to each set of nozzles constant for each printing signal sent to the set of nozzles if the total quantity of printing data value is greater than a predetermined threshold value;

storing the total quantity of printing data value corresponding to each set of nozzles in a memory; and generating printing signals and non-printing signals corresponding to each set of nozzles according to the printing data provided by the data transducer and the total quantity of printing data value stored in the memory, the printing signals controlling the heaters to generate sufficient heat energy to eject ink from the nozzles for printing data, and the non-printing signals controlling the heaters to generate heat energy that is not sufficient to eject ink from the nozzles for raising a temperature of the ink.

22. A method for heating a printhead in a printing apparatus, the printing apparatus comprising:

a printhead for ejecting ink from a plurality of sets of nozzles, the printhead comprising:

a substrate; and a plurality of heaters arranged on the substrate for heating ink in the printhead to generate bubbles in the ink and eject the ink through corresponding nozzles; and a data transducer for translating raw data into printing data;

the method comprising:

counting a total quantity of printing data value sent to each set of nozzles;

decreasing the total quantity of printing data value corresponding to each set of nozzles for each non-printing signal sent to the set of nozzles;

storing the total quantity of printing data value corresponding to each set of nozzles in a memory; and generating printing signals and non-printing signals corresponding to each set of nozzles according to the printing data provided by the data transducer and the total quantity of printing data value stored in the memory, the printing signals controlling the heaters to generate sufficient heat energy to eject ink from the nozzles for printing data, and the non-printing signals controlling the heaters to generate heat energy that is not sufficient to eject ink from the nozzles for raising a temperature of the ink.

* * * * *